US006116605A

United States Patent [19]

Davey, III

[11] Patent Number: 6,116,605

[45] Date of Patent: Sep. 12, 2000

[54] MAGNETIC TOSS GAME

[76] Inventor: Russell J. Davey, III, 69 Donna Dr., Plymouth, Mass. 02360

[21] Appl. No.: 09/262,557

[22] Filed: Mar. 4, 1999

[51] Int. Cl.[7] ..... A63F 7/20

[52] U.S. Cl. ..... 273/348.3; 273/317.1; 273/317.2; 273/317.3; 273/317.5; 273/317.6

[58] Field of Search ..... 273/317.1, 317.2, 273/317.3, 317.5, 348.3, 317.4, 317.6, 317

[56] References Cited

U.S. PATENT DOCUMENTS

| | | | |
|---|---|---|---|
| 1,926,612 | 9/1933 | Day . | |
| 1,928,768 | 10/1933 | Sell et al. | 273/317.2 X |
| 2,562,089 | 7/1951 | Fishlove . | |
| 2,645,491 | 7/1953 | Volman . | |
| 2,863,665 | 12/1958 | Gerosolina . | |
| 2,928,677 | 3/1960 | McAdam . | |
| 3,124,356 | 3/1964 | Chordas | 273/317.1 |
| 3,147,976 | 9/1964 | Millar . | |
| 3,170,693 | 2/1965 | Felsher . | |
| 3,508,752 | 4/1970 | Lemon . | |
| 3,937,469 | 2/1976 | Cohen | 273/317.3 |
| 4,030,736 | 6/1977 | Petrusek . | |
| 4,305,587 | 12/1981 | O'Grady . | |
| 4,681,325 | 7/1987 | Sheem . | |
| 5,005,841 | 4/1991 | Klick . | |
| 5,110,127 | 5/1992 | Potter | 273/317.3 |
| 5,265,885 | 11/1993 | Blount | 273/348.3 |
| 5,664,782 | 9/1997 | Lacks et al. | 273/317.5 |
| 5,775,694 | 7/1998 | Jonsson | 273/348.3 |

*Primary Examiner*—Raleigh W. Chiu
*Attorney, Agent, or Firm*—John P McGonagle

[57] ABSTRACT

A magnetic toss game simulative of a sports game. The game is comprised of a number of flat magnetic disks simulating hockey pucks, soccer balls, footballs, basketballs, golf balls, and the like. Each type of magnetic disk has a corresponding magnetic target simulating a hockey net, soccer goal net, football goal post, basketball net, golf green with hole, and the like. The magnetic target is mounted on a refrigerator, or other flat metallic surface, preferably vertically oriented. The magnetic target mounted on the flat metallic surface forms a game board capable of magnetic interaction with the magnetic disks.

16 Claims, 3 Drawing Sheets

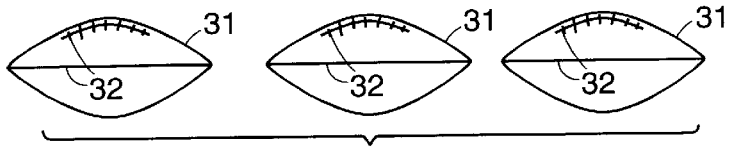
FIG. 3A
FIG. 3B
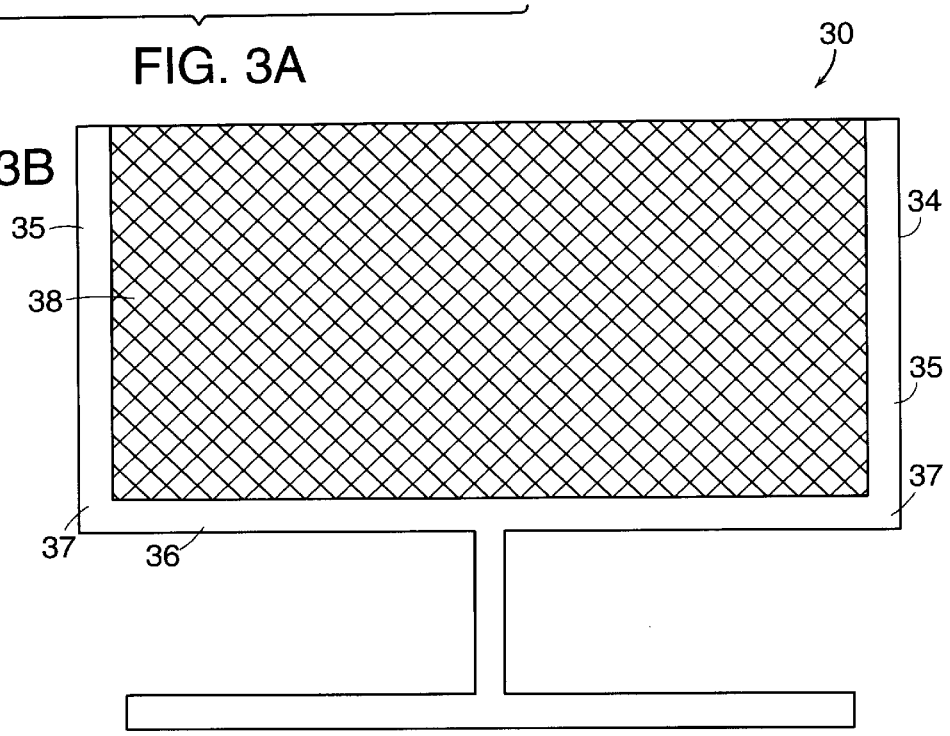
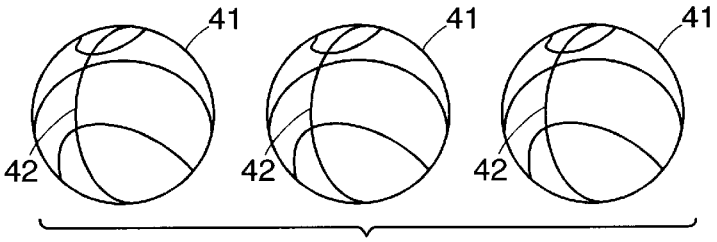
FIG. 4A
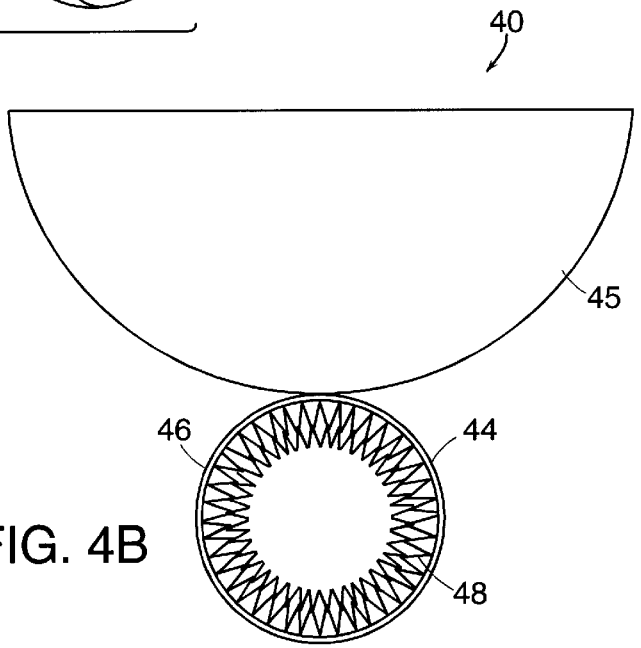
FIG. 4B

MAGNETIC TOSS GAME

BACKGROUND OF THE INVENTION

This invention relates to games, and in particular to a magnetic toss game which simulates popular games, such as hockey, soccer, football, basket ball, golf and the like.

The present invention provides a game apparatus involving the use of magnetic game pieces and magnetic interaction to secure the pieces to a target area.

A number of games have been developed which involve the use of magnetism to secure pieces to the game. These games include puzzle type games, bingo type games and dart or projectile type games.

U.S. Pat. No. 4,305,587 to O'Grady discloses a Magnetic Game and Method which involves a rigid backed game board which itself is magnetized to attract the projectiles thrown at it. U.S. Pat. No. 4,676,509 to Bishop discloses a Molded Bingo Chip with Magnetic Structure Secured Therein. The chip is a bingo marker containing a preformed slot into which is placed a structure of magnetic material upon which another layer of material is placed and secured, thus sealing the magnetic structure in the bingo marker. U.S. Pat. No. 4,172,597 to Smith et al. discloses a ferromagnetic device for attracting and picking up circular or disc-like marker means which comprise an enmeshed magnetizable metallic screen. U.S. Pat. No. 3,876,207 to Jones and U.S. Pat. No. 3,122,684 to Genin disclose magnetized game boards designed to attract magnetic game pieces. U.S. Pat. No. 5,005,841 to Klick discloses a game board comprised of a metallic wire screen embedded between two layers of flexible plastic. U.S. Pat. No. 4,681,325 to Sheem discloses a magnetic dart game simulating ball games such as football, baseball and basketball.

SUMMARY OF THE INVENTION

The present invention is comprised of a number of flat magnetic disks simulating hockey pucks, soccer balls, footballs, basketballs, golf balls, and the like. Each type of magnetic disk has a corresponding magnetic target simulating a hockey net, soccer goal net, football goal post, basketball net, golf green with hole, and the like. The magnetic target is mounted on a refrigerator, or other flat metallic surface, preferably vertically oriented. The magnetic target mounted on the flat metallic surface forms a game board capable of magnetic interaction with the magnetic disks. As such, the general purpose of the present invention, which will be described subsequently in greater detail, is to provide a new magnetic toss game simulative of popular sports game.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 3A is a plan view of the magnetic disks simulating footballs.

FIG. 3B is a plan view of a target simulating football goal posts.

FIG. 4A is a plan view of the magnetic disks simulating basket balls.

FIG. 4B is a plan view of a target simulating a basket ball net.

DETAILED DESCRIPTION OF THE INVENTION

Figure 1A:
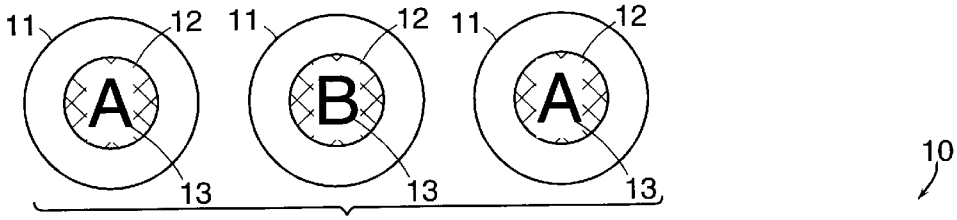
FIG. 1A is a plan view of magnetic disks simulating hockey pucks.
Figure 1B:
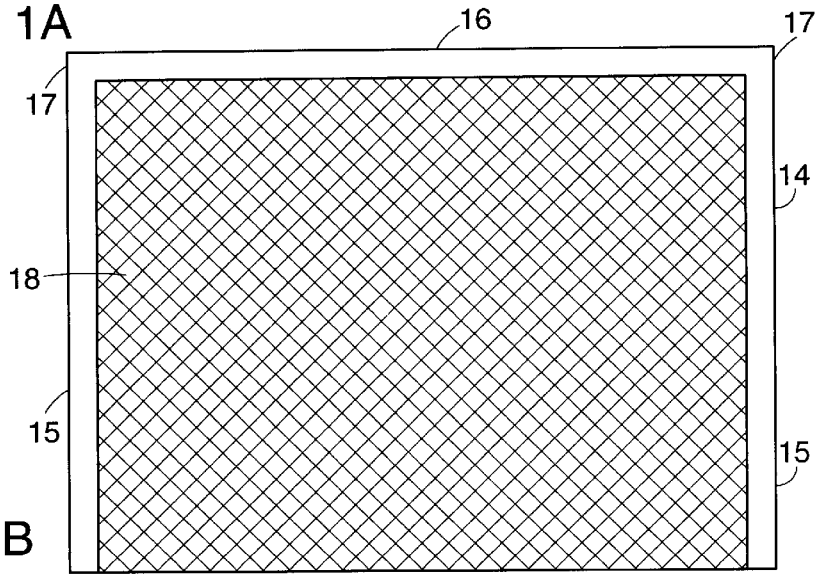
FIG. 1B is a plan view of a target simulating a hockey net.

Referring to the drawings in detail wherein like elements are indicated by like numerals, there is shown in FIGS. 1A and 1B an embodiment of the invention 10 simulative of a hockey game. The game 10 is comprised of several pucks 11 and a target 14. The pucks 11 are comprised of flat, round magnetic disks. The disks 11 are approximately two and one-half to three inches in diameter and have a center area 12 for application of a label 13. In this embodiment of the invention, there are two sets of pucks 11 each set being made up of three pucks. The pucks in each set have the same colored labels, said pucks in one set having a different colored label from the pucks in another set. The target 14 is simulative of a hockey net and is removably attached to a flat surface 1, such as a refrigerator 2, or other flat metallic surface, preferably vertically oriented. The target 14 is comprised of two parallel vertical posts 15 and a top horizontal post 16 interconnecting the tops 17 of the vertical posts 15. The posts 15, 16 are made from magnetic material and magnetically attach to said flat metallic surface 1. A light, thin netting 18 is fixedly attached to said posts 15, 16. The netting 18 may optionally be magnetized, but is not required to be. In this embodiment of the invention, the vertical posts 15 are each nine inches long and the horizontal post 16 is twelve inches long. In operation, the target 14 is mounted on a flat surface 1 and each player takes a set of pucks 11. The players take turns throwing pucks 11 at the target netting 18 and keep score.

Figure 2A:
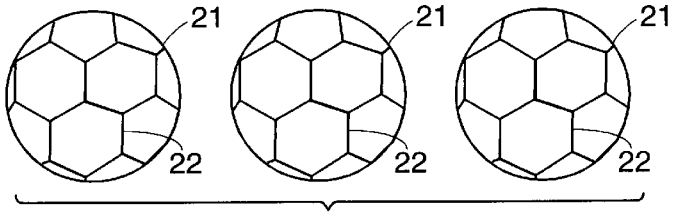
FIG. 2A is a plan view of magnetic disks simulating soccer balls.
Figure 2B:
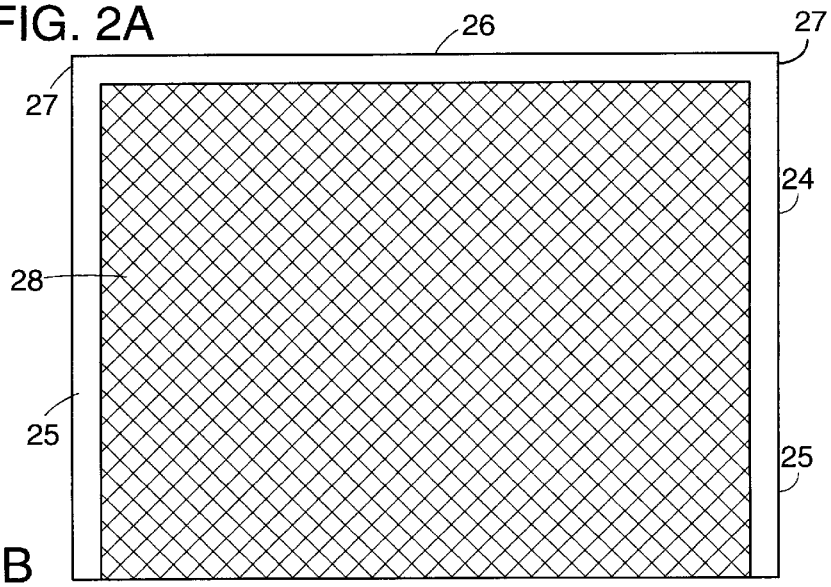
FIG. 2B is a plan view of a target simulating a soccer goal.

There is shown in FIGS. 2A and 2B an embodiment of the invention 20 simulative of a soccer game. The game 20 is comprised of several "balls" 21 and a target 24 simulating a soccer goal. The balls 21 are comprised of flat, round magnetic disks. The disks 21 are approximately two and one-half to three inches in diameter and have soccer ball markings 22. In this embodiment of the invention, there are two sets of balls 21 each set being made up of three balls. The balls in each set have a unique color, said balls in one set having a different color from the balls in another set. The target 24 is removably attached to a flat surface 1, such as a refrigerator 2, or other flat metallic surface, preferably vertically oriented. The target 24 is comprised of two parallel vertical posts 25 and a top horizontal post 26 interconnecting the tops 27 of the vertical posts 25. The posts 25, 26 are made from magnetic material and magnetically attach to said flat metallic surface 1. A light, thin netting 28 is fixedly attached to said posts 25, 26. The netting 28 may optionally be magnetized, but is not required to be. In this embodiment of the invention, the vertical posts 25 are each nine inches long and the horizontal post 26 is twelve inches long. In operation, the target 24 is mounted on a flat surface 1 and each player takes a set of balls 21. The players take turns throwing balls 21 at the target netting 28 and keep score.

There is shown in FIGS. 3A and 3B an embodiment of the invention 30 simulative of a football game. The game 30 is comprised of several "footballs" 31 and a target 34 simulating football goal posts. The footballs 31 are comprised of flat, oval-shaped, magnetic disks. The disks 31 are approximately two inches by three inches and have football markings 32. In this embodiment of the invention, there are two sets of footballs 31 each set being made up of three footballs. The footballs in each set have a unique color, said footballs in one set having a different color from the footballs in another set. The target 34 is removably attached to a flat surface 1, such as a refrigerator 2, or other flat metallic surface, preferably vertically oriented. The target 34 is comprised of a miniature football goal post arrangement with two parallel vertical posts 35 extending vertically upward from a bottom horizontal post 36 interconnecting the bottoms 37 of the vertical posts 35. The posts 35, 36 are made from magnetic material and magnetically attach to said flat metallic surface 1. A light, thin netting 38 is fixedly attached to said posts 35, 36. The netting 38 may optionally be magnetized, but is not required to be. In this embodiment of the invention, the vertical posts 35 are each twelve inches long and the horizontal post 36 is nine inches long. In operation, the target 34 is mounted on a flat surface 1 and each player takes a set of footballs 31. The players take turns throwing footballs 31 at the target netting 38 and keep score.

There is shown in FIGS. 4A and 4B an embodiment of the invention 40 simulative of a basket ball game. The game 40 is comprised of several "basket balls" 41 and a target 44 simulating a basketball net. The basket balls 41 are each comprised of a flat, round, magnetic disk. The disks 41 are approximately two and one-half to three inches in diameter and have basket ball markings 42. In this embodiment of the invention, there are two sets of basket balls 41 each set being made up of three basket balls. The basket balls in each set have a unique color, said basket balls in one set having a different color from the basket balls in another set. The target 44 is removably attached to a flat surface 1, such as a refrigerator 2, or other flat metallic surface, preferably vertically oriented. The target 44 is comprised of a flat, miniature basket ball backboard 45 with a thin ring 46 projecting vertically downward from the backboard 45. The backboard 45 and ring 46 are made from magnetic material and magnetically attach to said flat metallic surface 1. A light, thin netting 48 is fixedly attached to said ring 46. The netting 48 may optionally be magnetized, but is not required to be. In this embodiment of the invention, the ring 46 has a diameter of from nine to twelve inches. In operation, the target 44 is mounted on a flat surface 1 and each player takes a set of basket balls 41. The players take turns throwing basket balls 41 at the target netting 48 and keep score.

Figure 5A:
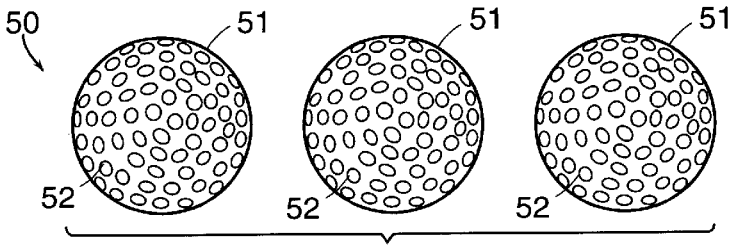
FIG. 5A is a plan view of the magnetic disks simulating golf balls.
Figure 5B:
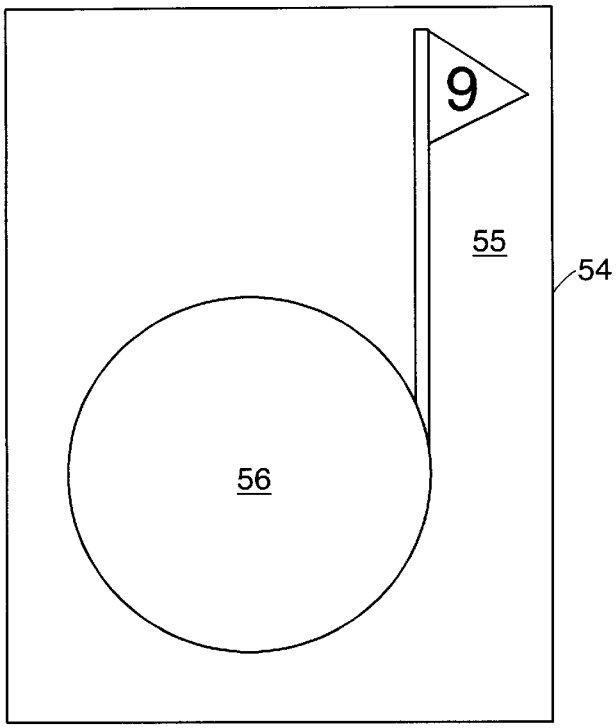
FIG. 5B is a plan view of a target simulating a golfing green and cup.
Figure 6:
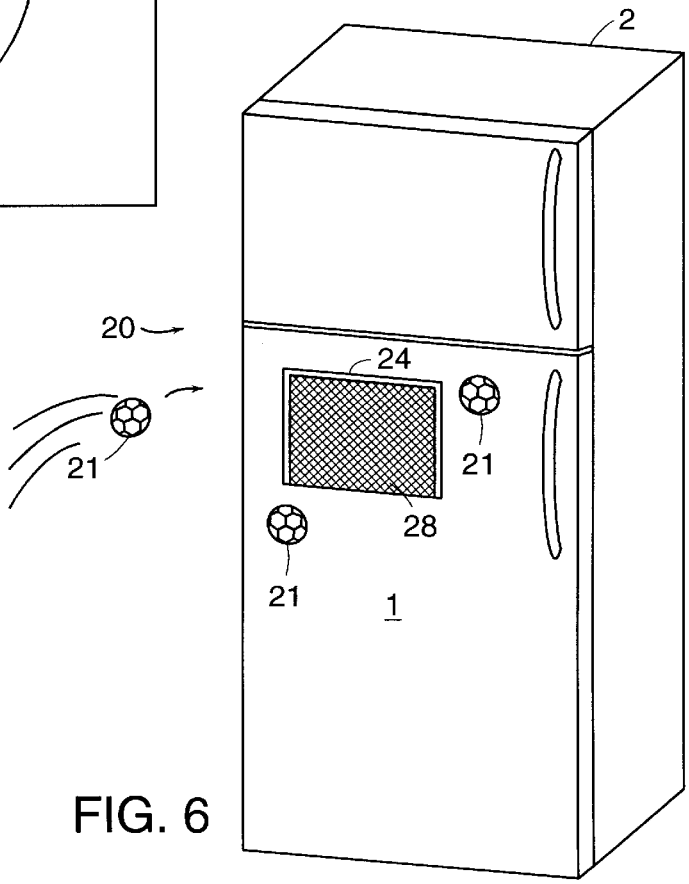
FIG. 6 is a perspective view of the soccer balls and net shown in FIGS. 2A and 2B mounted on a refrigerator.

There is shown in FIGS. 5A and 5B an embodiment of the invention 50 simulative of a golfing game. The game 50 is comprised of several "golf balls" 51 and a target 54 simulating a golfing green and cup. The golf balls 51 are each comprised of a flat, round, magnetic disk. The disks 51 are approximately one and one-half to two inches in diameter and have golf ball 52. In this embodiment of the invention, there are two sets of golf balls 51 each set being made up of three golf balls. The golf balls in each set have a unique color, said golf balls in one set having a different color from the golf balls in another set. The target 54 is removably attached to a flat surface 1, such as a refrigerator 2, or other flat metallic surface, preferably vertically oriented. The target 54 is comprised of a thin, generally rectangular play area 55 with a round "hole" 56 on the play area 55. The play area 55 is nominally twelve inches by nine inches. The hole 56, i.e., golf cup, has a diameter of from five to six inches. The hole area 56 is black and the remainder of the play area 55 is green. Other markings, such as a flag, may be imprinted on the play area 55. In operation, the target 54 is magnetically mounted on a flat surface 1 and each player takes a set of golf balls 51. The players take turns throwing golf balls 51 at the hole 56 in the play area 55 and keep score.

It is understood that the above-described embodiments are merely illustrative of the application. Other embodiments may be readily devised by those skilled in the art which will embody the principles of the invention and fall within the spirit and scope thereof.

I claim:

1. A magnetic toss game simulative of a sports game, comprising:

a plurality of flat magnetic disks simulating a sports projectile;

a corresponding magnetic target simulating a corresponding sports target, said magnetic target being removably attached to a flat metallic surface;

wherein said magnetic target attached to the flat metallic surface forms a game board adapted for magnetic interaction with the magnetic disks.

2. A magnetic toss game as recited in claim 1, wherein:

said sports game simulated is a hockey game, wherein said disks simulate pucks and said target simulates a hockey net.

3. A magnetic toss game as recited in claim 2, wherein said target is comprised of:

two parallel vertical posts having tops and a top horizontal post interconnecting the tops of the vertical posts, said posts being made from magnetic material and magnetically attach to said flat metallic surface;

a light, thin netting is fixedly attached to said posts.

4. A magnetic toss game as recited in claim 3, wherein:

said disks each have a center area for application of a unique identifier.

5. A magnetic toss game as recited in claim 1, wherein said sports game simulated is a soccer game, wherein said disks simulate soccer balls and said target simulates a soccer goal.

6. A magnetic toss game as recited in claim 5, wherein said target is comprised of:

two parallel vertical posts having tops and a top horizontal post interconnecting the tops of the vertical posts, said posts being made from magnetic material and magnetically attach to said flat metallic surface;

a light, thin netting is fixedly attached to said posts.

7. A magnetic toss game as recited in claim 6, wherein:

said disks each have soccer ball markings thereon.

8. A magnetic toss game as recited in claim 1, wherein:

said sports game simulated is a football game, wherein said disks simulate footballs and said target simulates football goal posts.

9. A magnetic toss game as recited in claim 8, wherein said target is comprised of:

a miniature football goal post arrangement having two parallel vertical posts with bottoms extending vertically upward from a bottom horizontal post interconnecting the bottoms of the vertical posts, said posts being made from magnetic material and magnetically attach to said flat metallic surface;

a light, thin netting fixedly attached to said posts.

10. A magnetic toss game as recited in claim 9, wherein:

said disks each have an oval shape and football markings thereon.

11. A magnetic toss game as recited in claim 1, wherein:

said sports game simulated is a basketball game, wherein said disks simulate basketballs and said target simulates a basketball net and backboard.

12. A magnetic toss game as recited in claim 11, wherein said target is comprised of:

a flat, miniature basket ball backboard with a thin ring projecting vertically downward from the backboard, said backboard and ring being made from magnetic material and magnetically attach to said flat metallic surface; and a light, thin netting fixedly attached to said ring.

13. A magnetic toss game as recited in claim 12, wherein:

said disks each have a round shape and basketball markings thereon.

14. A magnetic toss game as recited in claim 1, wherein:

said sports game simulated is a golfing game, wherein said disks simulate golf balls and said target simulates a golfing green and cup.

15. A magnetic toss game as recited in claim 14, wherein said target is comprised of:

a thin, generally rectangular magnetic play area with a round hole marked on the play area.

16. A magnetic toss game as recited in claim 15, wherein:

said disks each have a round shape and golf ball markings thereon.

* * * * *